United States Patent [19]

Grace

[11] 4,202,119

[45] May 13, 1980

[54] WATERWAY CLEANER WITH ENDLESS BUCKET CONVEYOR

[76] Inventor: Frederick J. Grace, 354 Gifford St., Apt. 4, Falmouth, Mass. 02540

[21] Appl. No.: 867,775

[22] Filed: Jan. 9, 1978

[51] Int. Cl.[2] ..... E02F 3/14; E02F 9/04

[52] U.S. Cl. ..... 37/69; 37/73; 37/75; 114/248

[58] Field of Search ..... 37/69, 72, 73, 75, 76, 37/77, 55; 114/248

[56] References Cited

U.S. PATENT DOCUMENTS

| | | | |
|---|---|---|---|
| 104,594 | 6/1870 | Howard | 37/69 |
| 288,091 | 11/1883 | Menge | 37/69 |
| 366,010 | 7/1887 | Knott | 37/69 |
| 619,601 | 2/1899 | McDougall | 37/73 |
| 1,307,370 | 6/1919 | O'Connell | 37/69 |
| 2,204,584 | 6/1940 | Flower | 37/55 X |
| 2,606,375 | 8/1952 | Braun et al. | 37/75 |
| 3,146,537 | 9/1964 | Von Bolhar | 37/69 |
| 3,874,101 | 4/1975 | Cummins | 37/69 |
| 3,919,790 | 11/1975 | Sasaki et al. | 114/248 X |

FOREIGN PATENT DOCUMENTS

| | | | |
|---|---|---|---|
| 199568 | 9/1958 | Austria | 37/69 |
| 694589 | 9/1964 | Canada | 37/69 |
| 67043 | 12/1950 | Netherlands | 37/69 |
| 1683 | 7/1859 | United Kingdom | 37/69 |

*Primary Examiner*—Clifford D. Crowder
*Attorney, Agent, or Firm*—Hauke and Patalidis

[57] ABSTRACT

A waterway cleaner comprising a hull supporting an extendable and swingable ladder mounted at one end, or bow, of the hull, a power driven endless chain of spaced scoops mounted on the ladder for scraping and excavating material from the bottom of a waterway and a belt conveyor on the deck of the hull extending beyond the stern of the hull for moving material dumped from the scoops to a dump scow. A pair of cables wound on power-driven winches, mounted one on each side of the hull, are used to displace the hull to a selected location on the waterway. A scraper is mounted vertically swingable around a pivot proximate the stern from a raised position to a submerged position in engagement with the waterway bottom. A pair of vertically movable legs positioned one on each side of the hull are adapted to engage the waterway bottom to stabilize the hull and maintain it in a fixed position. The scoops, conveyor and winches are operated by hydraulic motors. The swing of the ladder, the extension of the ladder and the movement of the scraper and legs are controlled by separate hydraulic jacks. All of the hydraulic components are supplied with fluid under pressure by a plurality of pumps driven by a single or a plurality of power sources.

8 Claims, 3 Drawing Figures

WATERWAY CLEANER WITH ENDLESS BUCKET CONVEYOR

BACKGROUND OF THE INVENTION

Dredges used to remove solid material from the bottoms of waterways and harbors usually consist of floating equipment, such as barges, on which are mounted apparatus which can be lowered to the bottom and which scoop up or suck up material from the bottom. This material is brought to the surface either by conveyor scoops or by entrainment in a fluid stream. Such dredges are exemplified by von Bolhar U.S. Pat. No. 3,146,537 and Skakel U.S. Pat. No. 3,160,996.

As pointed out in the von Bolhar patent, the maintenance of depth accuracy is an important consideration in many dredging operations. In addition, the smoothness of the bottom, after the dredging operation, is also of importance.

The waterway cleaner or dredge of the present invention comprises a combination of elements which provide the degree of control needed to achieve both accuracy of depth and smoothness of bottom without excessive stirring of loose material in the water, and without damaging the natural banks of the seawalls lining a waterway.

SUMMARY OF THE INVENTION

In the waterway cleaner or dredge of the present invention all operating and control functions are achieved through hydraulic motors or jacks operated by fluid pressure supplied by a number of pumps which are driven preferably by a single source of motive power, such as a diesel engine. The elements driven by hydraulic motors include a ladder whose end can be lowered to the bottom, and which is provided with an endless chain of spaced scoops, an endless belt conveyor moving the material dumped from the scoops to a dump scow, and a set of winches to position the cleaner or dredge at the exact spot where it is needed. Hydraulic jacks are used to place the ladder at a 45° angle with respect to the bottom and to raise or lower the ladder. Hydraulic jacks are also used to position a scraper blade, and to raise or lower a set of bottom-contacting legs which serve to hold the cleaner hull in position during operation.

DETAILED DESCRIPTION OF THE PREFERRED EMBODIMENTS

Figure 1:
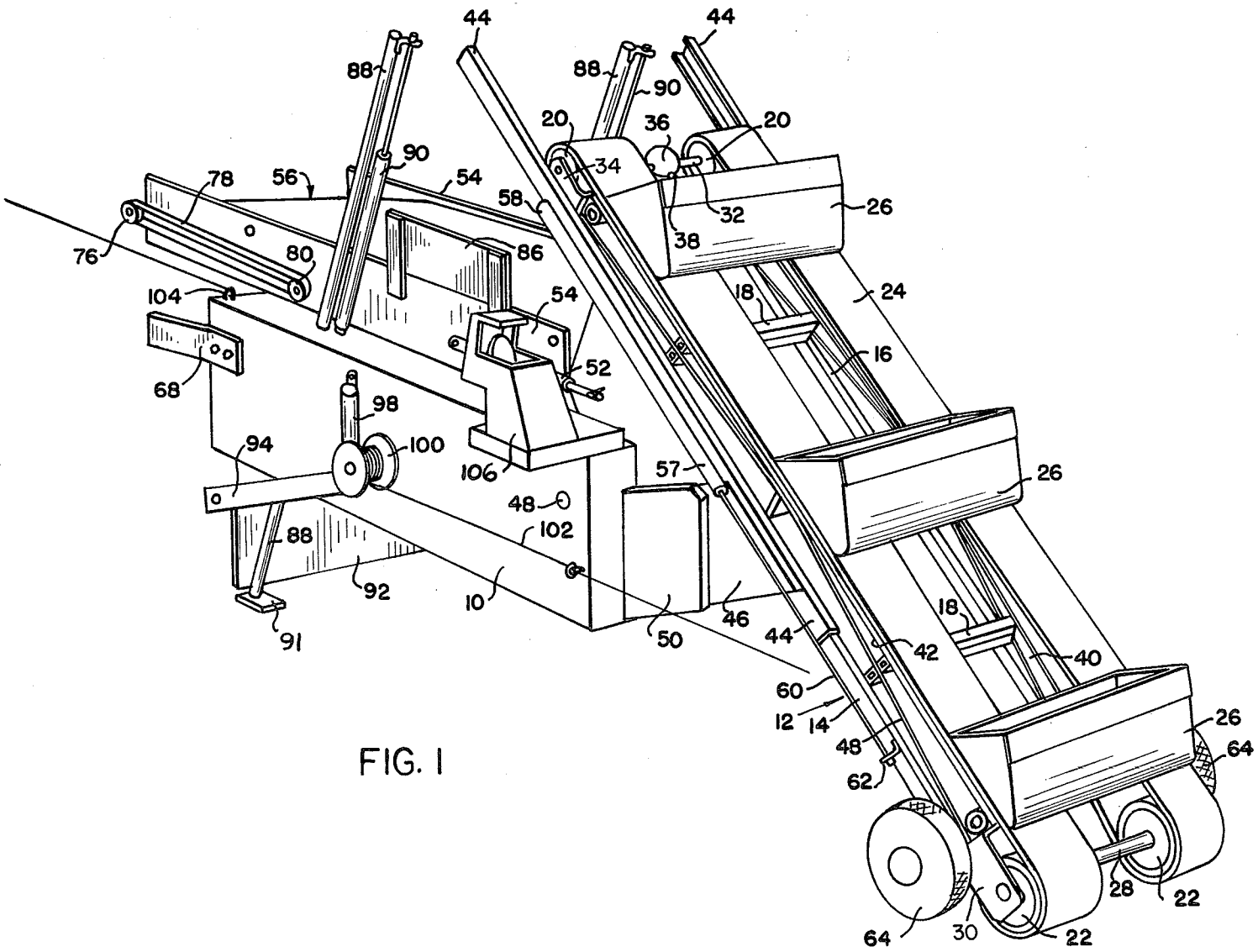
FIG. 1 is a perspective view illustrating a waterway cleaner or dredge according to the invention.

Referring to the drawing in general, and more particularly to FIG. 1, a waterway cleaner or dredge according to the present invention comprises a flat-bottom square ended hull 10, in which are preferably disposed a plurality of water-tight compartments, not shown, to insure continuous flotation under adverse conditions. The hull 10 may be of any appropriate size, but it is preferably made small enough in over-all dimensions for loading on a flat trailer for overland highway transportation. For example, the hull 10 may be about 30 feet in length and 14 feet in width for highway transportation on a flat semi-trailer.

The hull 10 supports on one end, or bow, a ladder 12 consisting of a pair of side frame members 14 which, together with longitudinal reinforcing members 16 and cross-members 18, form a rigid frame supporting at its upper end a pair of driving rollers 20, and at its lower end a pair of idle rollers 22. A pair of separate endless conveyor belts 24 support a plurality of evenly spaced buckets or scoops 26, the belts 24 wrapping around the periphery of the rollers 20 and 22 respectively. The idle rollers 22 are interconnected by means of a shaft 28, each end of which journals in an appropriate bearing plate or bracket 30 mounted on the end of each ladder side frame member 14. The driving rollers 20 are keyed, or otherwise fastened for rotation thereby, to a drive shaft 32, journaled at its ends in appropriate support brackets 34, each mounted on the other end of one of the ladder side frame members 14, and the drive shaft 32 is in turn driven through a right angle drive and gear box 36 by a propeller shaft 38 in turn driven by a hydraulic motor 39, FIG. 2, mounted in the framework of the ladder 12. In order to cut manufacturing costs, the assembly consisting of the drive shaft 32, the right angle drive 36 and the propeller shaft 38 may take the form of a conventional rear-end drive unit for trucks or tractors, readily available on the market.

The assembly of the ladder 12 further comprises appropriate bracing and reinforcing plates or members 40, and a pair of load carrying supporting side plates 42 disposed below the upper strand of each of the conveyor belts 24.

Each of the ladder side frame members 14 is slidably supported by a way or side rail member 44, each in turn welded or bolted to one of a pair of support and pivot plates 46, such that the whole ladder assembly 12 is pivotable relative to an end, or bow, of the hull 10 around a pivot member 48. A pair of abutment plates 50, each bolted or welded to one of the support and pivot plates 46, limit the amount of pivoting of the ladder assembly 12 from the horizontal, for transportation over water or over land of the hull 10, to an angle of about 45° to the original position, as illustrated in the drawing, for normal operation of the water cleaner of the invention while excavating and cleaning the bottom of a waterway. A pair of hydraulic jacks 52, one on each side, each having an end pivotably connected to one of the support and pivot plates 46 and its other end connected to the end of one of a pair of side plates 54 for a belt conveyor 56 mounted on the deck of the hull 10, permits to swing the ladder 12 from its inoperative transport position to its operative position illustrated in the drawing.

Figure 3:
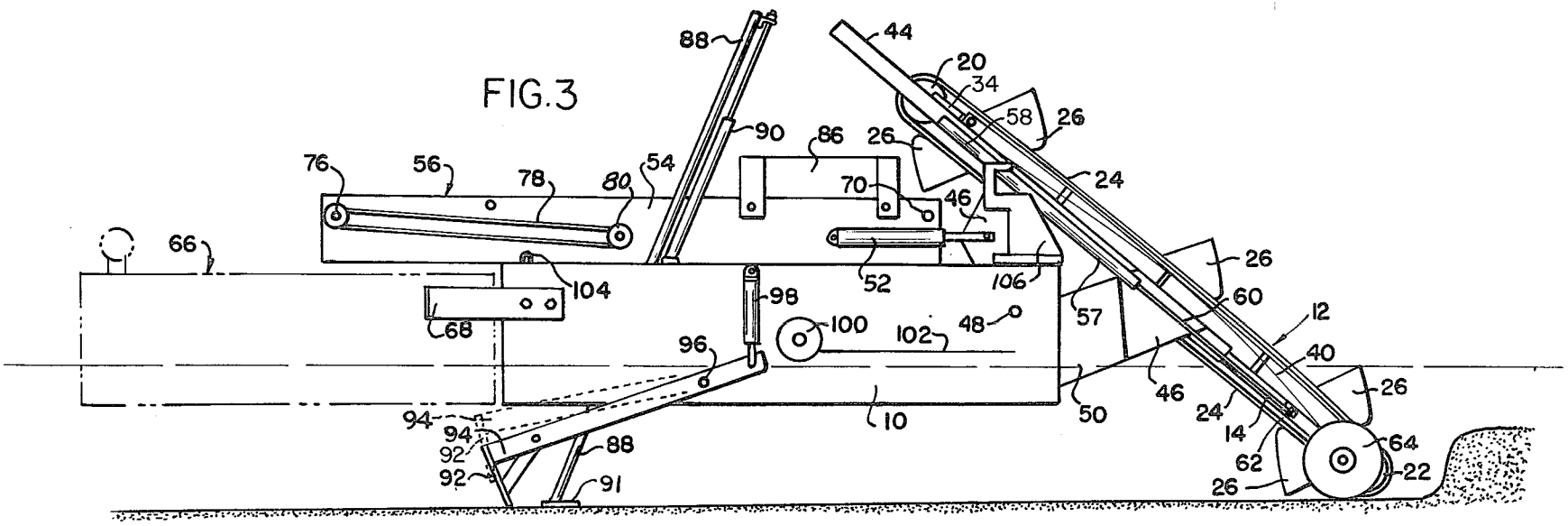
FIG. 3 is a side elevation of the waterway cleaner illustrated at FIGS. 1-2.

The ladder assembly 12 is capable of being extended to any appropriate position relative to the support ways or side rail members 44 by means of a pair of hydraulic jacks 57, one mounted on each side, and each having an end, such as the cylinder housing 58, fastened to the way or side rail member 44 and its other end, such as the end of its piston rod 60, attached to a bracket 62 in turn fastened to the ladder side frame member 14. A pair of freely rotatable wheels 64 are mounted, one on each side, proximate the lower end of the ladder assembly 12, and support the ladder from the bottom of a waterway, as best shown at FIG. 3, when the ladder is in operation and the scoops 26, driven by the endless conveyor belts 24, are displaced such as to scoop material from the bottom of the waterway.

The material removed from the bottom of the waterway by the buckets or scoops 26 is dumped, when a scoop 26 reaches the top of its travel, on the conveyor 56 mounted on the top of the hull 10 and overhanging the other end, or stern, of the hull 10 opposite to the end of which is mounted the ladder assembly 12. As best shown at FIG. 3, a dump scow or barge 66 is normally tied to the end of the hull 10 to be loaded with the material conveyed into the barge hold by the conveyor 56. A pair of lateral guiding brackets 68 are each mounted on a side of the hull 10, projecting beyond the stern end thereof, for guiding the barge or scow 66 in appropriate alignment with the hull 10 to insure that the material discharged by the conveyor 56 is discharged properly into the hold of the barge or scow.

The coneyor 56 comprises a pair of side boards or plates 54 mounted on the top of the deck of the hull 10 which support at one end an idle roller 70 and at the other end a driving roller 72, both journalled in appropriate bearings in each side plate 54, and supporting an endless conveyor belt 74. Each end of the driving roller 72 is provided with a pulley 76 driven by means of a belt 78 from a drive pulley 80. Each drive pulley 80 is mounted on an end of a drive shaft 82, FIG. 2, in turn driven through a gear train 83 and propeller shaft 84 by a prime mover such as a hydraulic motor 85 mounted on the frame, not shown, of the conveyor 56 between the two side plates 54 and between the upper and lower strand of the endless belt 74. For the purpose of reducing manufacturing costs, the assembly of the drive shaft 82, gear train 83 and propeller shaft 84, may consist of a rear axle drive for trucks or tractors, readily available on the market.

The conveyor belt 74, preferably, consists of several sections of endless conventional conveyor belts disposed side by side, and appropriate support rollers and support plates, not shown, are conveniently disposed below the conveyor belt to aid in supporting the load thereon and for preferably shaping the conveyor such that the portion thereof proximate the ladder 12 has a substantially flat surface while the portion thereof directed towards the end projecting beyond the hull 10 progressively tapers downwardly to aid in unloading the material conveyed by the conveyor into the receiving barge or scow 66. At the point of discharge of the buckets or scoops 26 onto the conveyor 56, the conveyor side plates 54 are provided with upward extending side-board portions 86 for aiding in containing the material discharged by the scoops and directing such material onto the upper surface of the conveyor 56 while preventing excess material from being discharged over the side of the side plates 54. The end of the conveyor 56 overhangs the scow 66 so that material discharged from the conveyor is dumped near the center of the scow cargo hold. The scow 66 is tied to davits or rings 104 mounted at the stern of the hull 10. The davits or rings 104 may also be used as attachment points for towing cables or tie-down cables, and for attaching the ends of cables used for hauling the hull on the flatbed of an overland transportation conveyance.

The hull 10 is further provided with a pair of laterally disposed telescopic legs 88, each actuated by a hydraulic jack 90. Each telescopic leg 88 when extended projects through the bottom of the hull 10 and is provided on its end with a foot 91 adapted to engage the soil at the bottom of a waterway, FIG. 3. The legs 88 extend at an angle to provide better footing at the bottom of the waterway when the scoops 26 of the ladder 12 are excavating the bottom and for opposing the reaction force applied to the hull 10 which would tend to back up the hull while excavating progresses. In addition, because of the angular disposition of the legs 88, reciprocating the legs by means of the hydraulic jacks 90 makes it possible to rock the hull and propel it forward, to a limited degree, by pushing against the bottom of the waterway.

Figure 2:
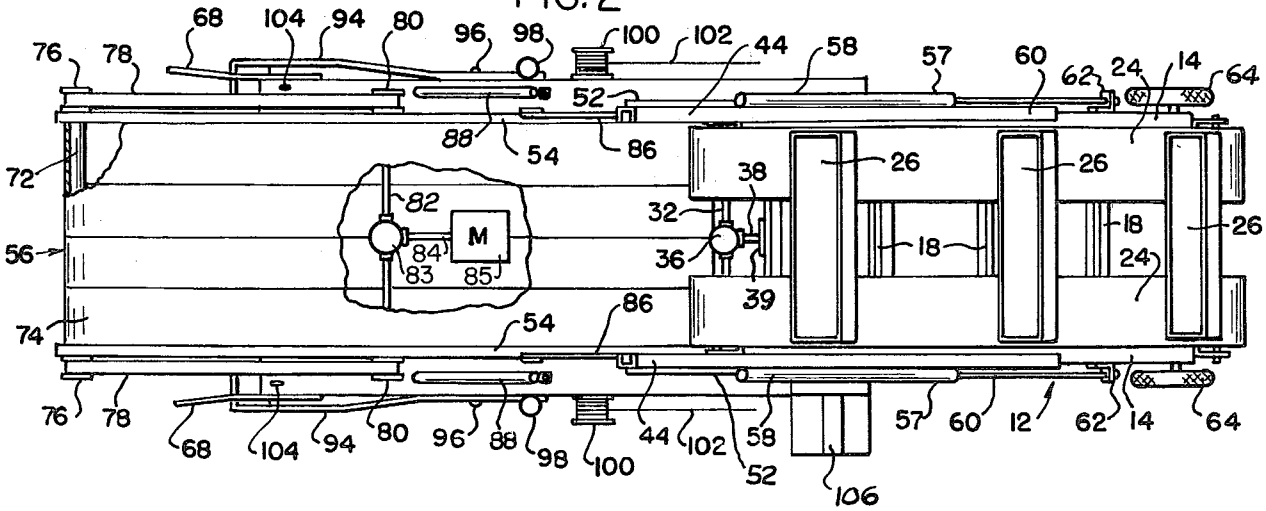
FIG. 2 is a top plan view of the waterway cleaner illustrated at FIG. 1.

A scraper blade 92, supported by a pair of pivotable arms 94 disposed on each side of the hull 10 and pivotable around a pivot point 96, FIGS. 2 and 3 is actuated from a fully retracted position to a pivotably retracted position, shown in dashed lines at FIG. 3, to an extended operative position by means of a pair of hydraulic jacks 98. In the extended position, the scraper blade 92 operates both as a planing device for smoothing the bottom of the waterway and as a further anchoring device preventing the hull 10 from backing up when the ladder scoops 26 are excavating.

It will be appreciated that the hull 10 may be propelled by conventional means such as a propeller screw, but preferably, and as illustrated, it is propelled, as the exavation work progresses, by means of a pair of power-driven winches 100 each winding a cable 102, the end of which is securely anchored, for example, to anchoring means planted in the banks or at the bottom of the waterway. As the winches 100 are operated by their individual hydraulic motors, not shown, the hull 10 is hauled along the waterway at an appropriate speed as excavation work progresses. By differentially operating the winches 100, the hull 10 may be caused to follow curves or a sinuous waterway.

A cab 106 is mounted on a side of the hull 10 to provide a shelter for an operator. All the controls for the operation of the waterway cleaner of the invention are mounted in the cab 106 within easy reach of the operator.

Hydraulic power for the diverse hydraulic jacks and for the hydraulic motors driving the ladder drive rollers 20, the conveyor 56 and the hauling winches 100 is obtained from a plurality of hydraulic pumps, not shown, preferably driven by a single prime mover such as a diesel engine, not shown, mounted in the hull 10. The transmission of fluid under pressure from the pumps to the various hydraulic jacks and hydraulic motors is by means of pipes or lines controlled by a valve network in which the valves are manually or electrically operated, or a combination of both, from the cab 106. The motive power for the pumps, the pumps themselves, the hydraulic jacks, the hydraulic motors and the valve network are all conventional in design and are not shown or described in detail.

In operation, the hull 10 is positioned at a selected location on the waterway and stabilized by means of the legs 88 and the scraper 92. A dump scrow 66 (FIG. 3) is drawn between the guides 68 and tied to the stern of the hull 10. The ladder 12 is then positioned at a 45° angle and extended until the wheels 64 make contact with the bottom of the waterway. The conveyor 56 and the chain of scoops 26 are placed in operation and material from the bottom of the waterway is brought up by the scoops 26 and transported by the conveyor 56 to the hold of the dump scow 66. The hull 10 is slowly advanced by means of the winches 100 hauling on the lines 102 until the limit of the area to be cleaned in reached. During advance of the hull 10 the legs 88 and the scraper 92 are adjusted so that they create a drag preventing the hull from backing up but do not interfere with forward progress of the hull. Excavation and cleaning of the waterway bottom may be made in a single pass or by a series of progressively deeper passes.

The depth of excavation is determined by the depth to which is extended the ladder assembly 12, with the scoops 26 operating. Once an appropriate depth is reached, the same depth is held while the work progresses by maintaining the ladder assembly to an appropriate extension, in view of the fact that the wheels 64 in rolling engagement with the bottom floor of the waterway provide support for the ladder and excavation depth control. Appropriate graduations may be provided along the ladder extension hydraulic jack rod 60, or along the side frame members 44, in full view of the operator, to provide him with an accurate indication of the depth at which the digging is effected. Remote indicators may also be provided, with appropriate gauges placed in the cab 106.

Having thus described the present invention by way of a specific structural embodiment thereof, modification whereof will be apparent to those skilled in the art, what is claimed as new is as follows:

1. A waterway cleaner comprising a floating hull, an extendable and pivotable ladder mounted at one end of said hull, means for controlling the angular position of said ladder from a non-operative substantially horizontal position to a downwardly inclined operative position, means for extending and retracting said ladder in each of said positions, an endless chain of spaced scoops mounted on said ladder, means for driving said endless chain, an endless belt conveyor mounted on the top of said hull, said belt conveyor projecting beyond the otheer end of said hull and being adapted to convey material dumped by said scoops to a scow tied to said other end of said huil, a pair of substantially parallel telescoping legs projecting from the bottom of said hull, each disposed in a substantially vertical plane proximate one side of said hull and each being inclined at a predetermined angle toward said other end of said hull and having an end engageable with the bottom of the waterway, means for telescopically reciprocating each of said legs for controllably engaging said end thereof with the bottom of the waterway for providing additional support for said hull and for forwardly propelling said hull, a scraper blade mounted swingable at said other end of said hull and positionable from an elevated position to a submerged position for engagement with the bottom of said waterway, means for displacing said scraper from said first to said second position, and a pair of freely rotatable support wheels each fastened to one side of said ladder proximate the lower end thereof for rolling engagement with said bottom of said waterway.

2. The waterway cleaner of claim 1 further comprising a pair of winches each mounted on a side of said hull, a cable winding on each of said winches for displacing said hull by hauling on said cable, and means for driving said winches.

3. The waterway cleaner of claim 2 further comprising a pair of guide brackets projecting from said other end of said hull for maintaining a dump scow in alignment with said hull at said other end.

4. The waterway cleaner of claim 1 further comprising a pair of guide brackets projecting from said other end of said hull for maintaining a dump scow in alignment with said hull at said other end.

5. The waterway cleaner of claim 1 wherein said means for controlling the angular position of said ladder, said means for extending said ladder and said means for reciprocating and controlling the vertical position of said legs are hydraulic jacks.

6. The waterway cleaner of claim 5 further comprising a pair of winches each mounted on a side of said hull, a cable winding on each of said winches for displacing said hull by hauling on said cable, and means for driving said winches.

7. The waterway cleaner of claim 6 further comprising a pair of guide brackets projecting from said other end of said hull for maintaining a dump scow in alignment with said hull at said other end.

8. The waterway cleaner of claim 1 wherein said means for displacing said scraper are hydraulic jacks.

* * * * *